US010669817B2

(12) United States Patent
Shanfield et al.

(10) Patent No.: US 10,669,817 B2
(45) Date of Patent: Jun. 2, 2020

(54) DOWNHOLE SENSOR SYSTEM USING RESONANT SOURCE

(71) Applicant: The Charles Stark Draper Laboratory, Cambridge, MA (US)

(72) Inventors: Stanley Shanfield, Newton, MA (US); Adam J. Greenbaum, Boston, MA (US); Mark Prestero, Ipswich, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 232 days.

(21) Appl. No.: 15/783,670

(22) Filed: Oct. 13, 2017

(65) Prior Publication Data

US 2019/0024481 A1 Jan. 24, 2019

Related U.S. Application Data

(60) Provisional application No. 62/535,578, filed on Jul. 21, 2017.

(51) Int. Cl.
*E21B 41/00* (2006.01)
*E21B 47/12* (2012.01)
(Continued)

(52) U.S. Cl.
CPC ..... *E21B 41/00* (2013.01); *E21B 47/011* (2013.01); *E21B 47/12* (2013.01); *E21B 47/121* (2013.01); *E21B 33/14* (2013.01)

(58) Field of Classification Search
CPC ..... E21B 41/0085; E21B 47/12; E21B 47/16
See application file for complete search history.

(56) References Cited

U.S. PATENT DOCUMENTS 4,511,844 A 4/1985 Tietze
5,087,873 A 2/1992 Murphy et al.
(Continued)

FOREIGN PATENT DOCUMENTS

WO WO 01/65066 9/2001
WO WO 03/029615 4/2003

OTHER PUBLICATIONS

International Search Report and Written Opinion of the International Searching Authority, dated Oct. 18, 2018, from International Application No. PCT/US2018/042981, filed Jul. 20, 2018. 14 pages.
(Continued)

*Primary Examiner* — Jennifer H Gay
(74) *Attorney, Agent, or Firm* — HoustonHogle LLP

(57) ABSTRACT

A well telemetry system supplies power to downhole sensor nodes employed for obtaining telemetry data in oil wells. The nodes are held in the cement that lines the well and surround the casing. At the surface, an AC power unit is connected to the casing and geological structure that surrounds the cement. Power to nodes is supplied using an AC resonant circuit that generates standing waves of electrical power on the casing. Power from the standing waves is delivered to the nodes which are located at antinodes of the standing wave. The nodes are held in cement that surround the casing, with one of their two electrodes connected to the casing and the other connected to the cement or to geological structure.

20 Claims, 14 Drawing Sheets

(51) Int. Cl.
*E21B 47/01* (2012.01)
*E21B 33/14* (2006.01)

(56) References Cited

U.S. PATENT DOCUMENTS 5,126,654 A 6/1992 Murphy et al.
5,467,083 A 11/1995 McDonald et al.
5,467,823 A * 11/1995 Babour ..... E21B 33/14 166/250.01
5,745,047 A * 4/1998 Van Gisbergen ..... E21B 17/003 340/853.1
6,125,935 A * 10/2000 Shahin, Jr. ..... E21B 33/14 166/250.14
6,515,592 B1 2/2003 Babour et al.
6,587,037 B1 * 7/2003 Besser ..... E21B 43/128 340/538.11
6,633,164 B2 * 10/2003 Vinegar ..... E21B 17/003 324/355
6,633,236 B2 * 10/2003 Vinegar ..... E21B 43/122 166/73
6,747,569 B2 6/2004 Hill et al.
6,766,141 B1 7/2004 Briles et al.
6,898,149 B2 5/2005 Hill et al.
6,937,159 B2 8/2005 Hill et al.
6,958,704 B2 10/2005 Vinegar et al.
7,151,377 B2 * 12/2006 Chouzenoux ..... E21B 17/003 324/368
7,170,424 B2 1/2007 Vinegar et al.
7,504,963 B2 3/2009 Hall et al.
7,703,515 B2 4/2010 Chouzenoux et al.
7,880,484 B2 2/2011 Miller et al.
7,940,062 B1 5/2011 Miller et al.
8,106,791 B2 1/2012 Thompson et al.
8,390,471 B2 3/2013 Coates et al.
9,000,942 B2 * 4/2015 Atkinson ..... E21B 47/123 166/254.2
9,103,198 B2 8/2015 Gonzalez et al.
9,556,727 B2 1/2017 Saulnier et al.
9,601,270 B2 3/2017 Kurs et al.
9,638,027 B2 5/2017 Roberson
9,970,286 B2 * 5/2018 Godager ..... E21B 47/06
2001/0033164 A1 * 10/2001 Vinegar ..... E21B 17/003 324/312
2004/0263175 A1 * 12/2004 Chouzenoux ..... E21B 17/003 324/368
2008/0143552 A1 * 6/2008 Mallison ..... E21B 47/06 340/853.1
2012/0256634 A1 * 10/2012 Morys ..... E21B 43/2401 324/338
2013/0154383 A1 6/2013 Kasturi et al.
2014/0222343 A1 8/2014 Samson et al.
2014/0225748 A1 8/2014 Wilson
2014/0236357 A1 8/2014 Degrange
2015/0107824 A1 * 4/2015 Signorelli ..... E21B 41/0085 166/244.1
2016/0115753 A1 * 4/2016 Frazier ..... E21B 43/1185 166/53
2016/0201451 A1 * 7/2016 Godager ..... E21B 49/087 73/152.51
2016/0258284 A1 9/2016 Bittar et al.
2016/0268041 A1 9/2016 Deville et al.
2018/0058209 A1 * 3/2018 Song ..... E21B 47/10
2018/0082090 A1 * 3/2018 Roberson ..... G06K 7/10009
2018/0230795 A1 * 8/2018 Godager ..... E21B 49/087
2019/0024481 A1 * 1/2019 Shanfield ..... E21B 41/00

OTHER PUBLICATIONS

Grcev, L., "Modeling of Grounding Electrodes Under Lightning Currents," IEEE Transactiosn on Electromagnetic Compatibility, 51(3): 559-571 (2009).
Jinliang He, et al., "Laboratory Investigation of Impulse Characteristics of Transmission Tower Grounding Devices", IEEE Trans. Power Delivery, 18(3): 994-1001 (2003).
Makan, G., et al., "Real-Time Analysis of Mechanical and Electrical Resonances with Open Source Sound Card Software," 1-12.
International Preliminary Report on Patentability dated Jan. 30, 2020, from International Application No. PCT/US2018/042981, filed Jul. 20, 2018. 8 pages.

* cited by examiner

DOWNHOLE SENSOR SYSTEM USING RESONANT SOURCE

RELATED APPLICATIONS

This application claims the benefit under 35 USC 119(e) of U.S. Provisional Application No. 62/535,578, filed on Jul. 21, 2017, which is incorporated herein by reference in its entirety.

BACKGROUND OF THE INVENTION

The energy industry uses specialized tools and equipment to extract crude oil and gas located beneath the surface of the earth. A commonly used term for the technology used for this type of energy extraction is called downhole extraction technology. Special steel pipes, called casings, which can range in length from a few meters to several hundred meters, are joined together and inserted into boreholes, also called wellbores, bore wells, oil wells, or simply wells. They can be several kilometers deep. The main function of the casing is to separate well fluids from formation fluids, and prevent the wellbore from collapsing. The holes can be a meter or more wide on the surface and then shrink to several inches toward the bottom of the well. Some coiled-tubing wells are much smaller—on the order of 2-4 inches (5-10 cm).

During the drilling process and throughout the duration of the extraction project, telemetry sensors, often referred to simply as sensors, are used to monitor the wells. They can be placed at regular intervals on or near the casing, in the drill string and/or near the drill bit for the purpose of transmitting telemetry data to the surface station. The telemetry data, including accelerometer measurements (including direction), vibration, pressure, magnetic field measurements (including direction) and temperature, etc., are transmitted to the surface stations wirelessly using radio frequency (RF) signals, through wires, or acoustically. Since the telemetry data is crucial for ensuring the accuracy of drilling direction and location and the health of the well, it is necessary to ensure that the sensors function properly and reliably over the duration of energy wells, which could be several years.

The sensors are sometimes battery powered. This presents challenges, however. One main cause of sensor failure is rooted in batteries running out of capacity to power the sensors. One cause of premature battery failure is the high temperature inside the well, which could exceed 300° C. (or 573.15 K).

Another, possibly complimentary, approach to powering downhole sensors involves transmitting power from an external source. U.S. Pat. No. 9,103,198 B2, issued to Gonzales et al., 2015, discloses a system that uses the casing and wellstring pipe as an electrode pair to supply power to sensors and receive transmissions from the sensors. U.S. Pat. No. 8,106,791 B2 (Thompson et al., 2012), U.S. Pat. No. 8,390,471 B2 (Coates et al., 2013), U.S. Pat. No. 7,504,963 B2 (Hall, et al., 2009), and U.S. Pat. No. 6,515,592 B1 (Babour et al., 2003) disclose similar systems where casing and other nearby objects, which could be externally inserted, such as a wellstring, are used to deliver power to the sensors and receive signals emitted from those sensors.

SUMMARY OF THE INVENTION

There is a need to reliably transmit power to sensors from an externally controlled source, such as an above-ground AC power unit, which can supply power for the entire lifetime of the well. The present invention addresses this need and could, in principle, supply power to the sensors indefinitely.

This invention concerns the delivery of electrical power to multiple downhole nodes, such as sensors, placed along a well casing. Hereinafter the word "casing" will collectively denote the outer pipes that are typically joined together in the well, and individual pipes will be denoted as "sections of casing" or "casing sections". Typically, the delivered power can directly power the downhole nodes and/or charge and/or maintain the batteries that power the downhole nodes. A downhole node, or simply a node, here is typically a telemetry sensor or an actuator or a communications repeater. The nodes will typically be located just below the coupling joint of two sections of casing. At the couplings there may or may not be direct current (DC) connectivity, but they can still act as capacitors and allow alternating current (AC) power transmission through the coupling. The purpose of the delivered power is to operate a node, such as a node's sensing circuitry, battery charger (if present) and data transmit/receive electronics. The power can be supplied indefinitely, in contrast with any on-board energy supply unit, and be able to operate in the high temperature environment, possibly bypassing batteries.

The system typically uses an AC power supply unit as source of power, located on surface of earth. The AC unit of moderate frequency (≈10 kiloHertz (kHz)) is connected to the casing, making sure to prevent electric hazard by using appropriate insulation. The second terminal of the power unit is connected to: 1) a conductive stake in the cement that surrounds the casing in the situation where the cement is conductive or doped to be conductive, or 2) a conductive stake in the ground (geologic structure) away from the cement or concrete that surrounds the casing. The second scenario is presented as an alternative implementation of supplying power to nodes in this disclosure. The downhole nodes are placed in the cement that surrounds the casing, along the depth of the well. One electrode of the node is connected to the casing. The ground electrode of the node is mostly covered with insulation except at the bare tip that is exposed in and makes electrical contact with the cement that surrounds the casing and/or the surrounding geologic structure. The just mentioned geologic structure could be ground, soil, dirt, mud, earth, or rock, etc. Several nodes are placed throughout the well at regular intervals (≈30-500 m) and configured as just described. The nodes are preferably near the junction of casing sections of two different diameters.

In examples, the connections to the casing by the AC power unit and the node electrode can be made using a glass-to-metal seal with an electrically isolated "button."

The AC power is delivered in an optimal manner, using resonant circuitry, to the downhole nodes. Reference is made to a circuit model that approximates electrical characteristics of the casing and the well, including its effective impedance and capacitance of the junctions where two casing sections of different diameter are threaded together or "hung" of one another. A resonant circuit model of the AC unit and its configuration with the electrical characteristics yields the proper source voltage and frequency that deliver optimum power to the nodes.

In general, according to one aspect, the invention features a downhole node for a well. A node comprises a sensor housing set in cement, sensor electronics, surrounding casing of the well, a power electrode extending from the node housing to the casing, and a ground electrode extending from the node housing to the cement and/or geologic structure, where the ground electrode wire is bare at the tip.

The node will have node circuitry possibly including a tuned filter for receiving power via the power electrode and being grounded via the ground electrode. A bridge circuit will also be used for rectifying power transmitted via the casing. Finally, a regulated supply is helpful for conditioning the power transmitted via the casing.

In general, according to another aspect, the invention features a well telemetry system for a well. The system comprises one or more nodes set in cement, surrounding casing of the well and a power source for transmitting AC power to the nodes via the casing by establishing a standing wave in the casing.

In operation, the power source adjusts a frequency of the AC power to enable transmission of power to the nodes. The frequency is adjusted to ensure that the nodes are located at antinodes of the standing wave. Typically, a frequency of the AC power from the power source is tuned in response to data from the nodes.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
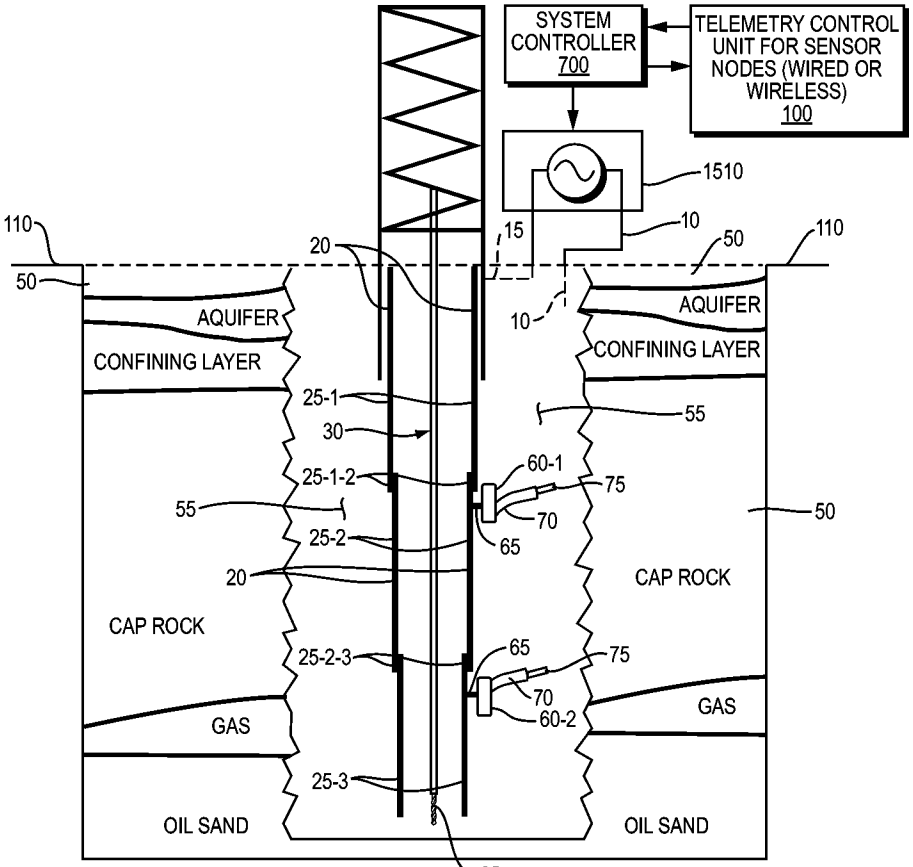
FIG. 1A is a schematic vertical cutaway of an oil extraction rig, showing the above ground oil platform, the well with casing and surrounding outer cement and geologic structure. In this figure the AC power supply circuit is completed, and power is delivered to nodes, using the casing and the cement.

FIG. 1A is a schematic of a vertical cross-sectional cutaway view of a hydrocarbon, e.g., oil and gas, extraction rig, showing a casing in a well and other equipment for extracting crude oil or gas. It shows the casing 20, constructed from steel pipes and pair-wise connected/threaded at couplings 25-1-2 and 25-2-3, sensor locations and the AC power unit. The salient aspects of this figure will now be described with emphasis on those parts and features that are of relevance to the present invention.

The casing 20 in the figure is shown as three steel pipes or casing sections 25-1, 25-2 and 25-3, counting from top. They are joined at two couplings 25-1-2 and 25-2-3. The first coupling 25-1-2 joins the first two pipes 25-1 and 25-2, the second coupling 25-2-3 joins the $2^{nd}$ and $3^{rd}$ pipes 25-2 and 25-3; and so on. At the couplings, there may or may not be DC connectivity, but the couplings act as capacitors which does allow AC current transmission.

As shown in the diagram, the gap between the hole in the geologic structure 50 and the casing is filled with cement 55. The cement 55 cylindrically lines the wall of the well and surrounds the well casing 20. Since the nodes are typically located just below the couplings, 25-1-2 and 25-2-3 will also denote node locations; i.e., location of nodes. The nodes 60-1 and 60-2 are encased in cement and attached to the casing just below couplings 25-1-2 and 25-2-3, in the illustrated example. The node ground terminal portions 70 and 75 are described later in connection with FIG. 3A. The AC power unit 1510, on surface of the earth 110, is connected to the casing via electrical connection 15; its second electrical connection is to a conductive stake 10 in cement. The system controller 700 is tasked with regulating the AC power unit 1510 including its frequency. The controller 700 also analyzes node inputs obtained via the telemetry control unit (TCU) 100. Finally, for completeness the drill string 30 and the drill bit 35 are shown in the figure. Note that bottom of the well is in a region of oil sand, rich in oil, which is pumped up to the top of the well.

Figure 1B:
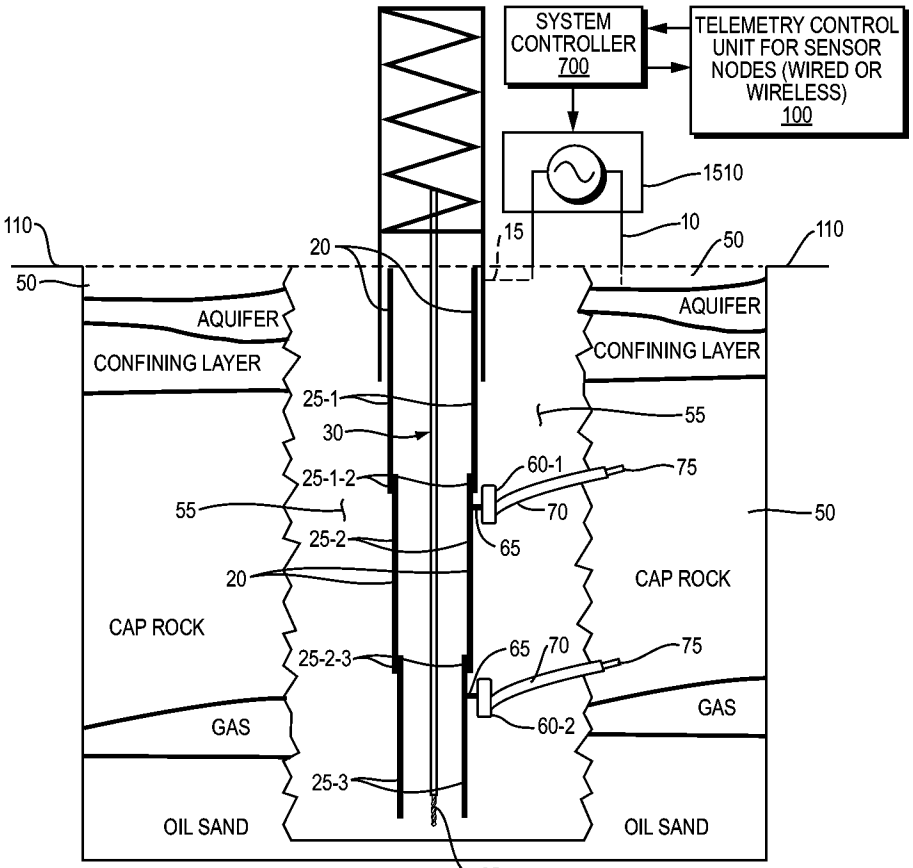
FIG. 1B is schematic that shows an alternate embodiment of the configuration shown in FIG. 1A. Here the AC circuit is completed, and power is delivered, using the casing and the geologic structure away from cement.

FIG. 1B is identical to FIG. 1A except for the location of the conductive stake 10, which connects to second terminal of the power unit 1510, and the configuration of node terminal portions 70 and 75. The conductive stake in the figure is outside cement and in the geologic structure. As discussed later, this requires corresponding changes in the configuration of node terminal portions 70 and 75.

Figure 2A:
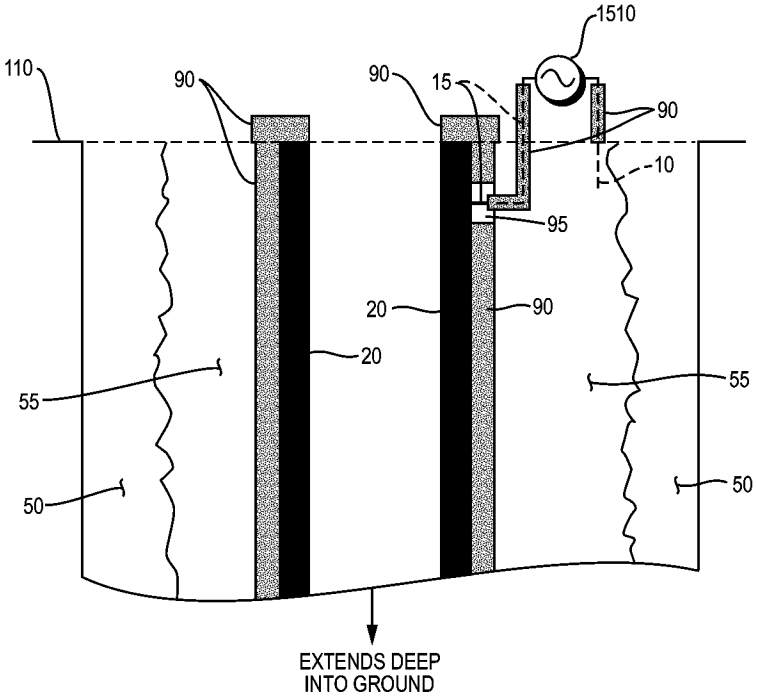
FIG. 2A which corresponds to FIG. 1A, is a vertical cutaway of the well showing the AC unit's electrical connections and the use of insulation to prevent electrical hazard from the high power AC unit.

FIG. 2A shows the connection of the above-ground AC power unit 1510 to the casing 20 via connection wire 15; its other connection is to a ground conductive stake 10 which is buried in cement 55, corresponding to FIG. 1A. To minimize electrical hazard at the surface and to improve efficiency of power delivery by eliminating leakage to the surroundings, the casing is coated with an electrical insulation 90. The insulation is peeled off at region 95 for connecting the casing 20 to the AC unit 15. The connections from the AC unit (15 and 10) are also insulated with insulator 90. The insulated material 90 can be plastic, PTFE (polytetrafluoroethylene), epoxy-based material, nylon and/or ceramic material.

Figure 2B:
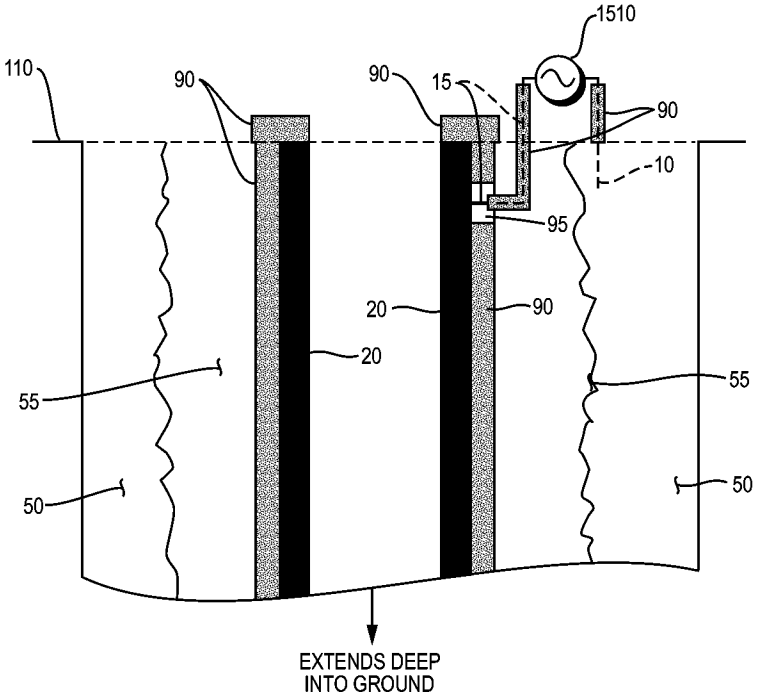
FIG. 2B, which corresponds to FIG. 1B, is a vertical cutaway of an alternate embodiment of the configuration shown in FIG. 2A.

FIG. 2B, corresponding to FIG. 1B, is identical to FIG. 2A except for the location of the conductive stake 10 which is buried here in the geologic structure 50, away from cement 55.

Figure 3A:
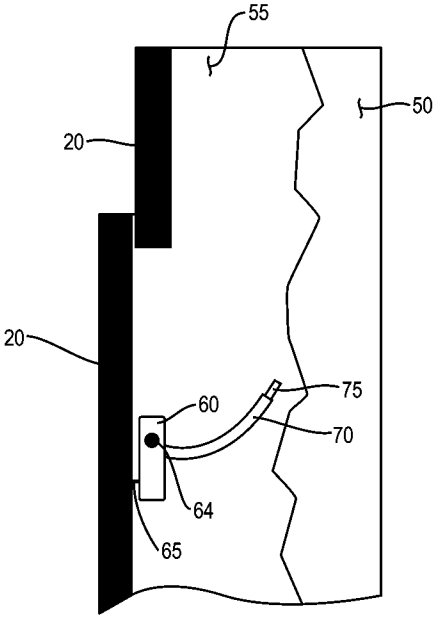
FIG. 3A, corresponding to FIG. 1A, is a magnified cutaway view of a downhole node set in cement and with its connections to the casing and surrounding cement.

FIG. 3A is a magnified view of the generic node 60 and its outer electrode connections. The figure corresponds to right side of FIG. 1A. Inside the node housing/packaging 62 the node circuitry 64 (see FIG. 8) and other electronics for sensing are encased. The electrode 65 connects to the casing 20 at an uninsulated section. The power connection of the electrode 65 is to the AC power unit 1510 via 15 (see FIGS. 1A and 2A). The node ground wire 70 has a tip 75 that is bare metal and it is electrically connected to cement 55 which provide a connection to the AC source wire 10 on surface of earth 110 as shown in FIG. 1A.

FIGS. 1A, 2A and 3A show that the AC power is delivered to nodes using the casing and the cement that surround the casing. Thus the AC circuit is completed using the casing and the cement. This assumes that the cement is conductive or doped to be conductive. One possible dopant to increase conductively is metal fibers or carbon, e.g., graphite.

Figure 3B:
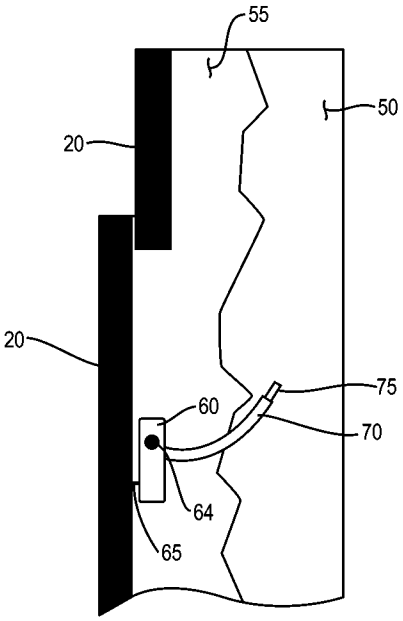
FIG. 3B, corresponding to FIG. 1B, is a magnified cutaway view of an alternate embodiment of the configuration.

An alternate embodiment of the AC power unit connection is possible where instead of cement the geologic structure can be used to complete the AC circuit. Thus, the AC unit supplies power to nodes using the casing and the geologic structure. This requires an alternate configuration of AC unit's ground connection 10 as shown in FIGS. 1B and 2B where the ground connection 10 is a stake buried in the geologic structure 50, away from cement 55. To complete the circuit, the ground terminal portions 70 and 75 of the node are configured as shown in FIG. 3B. In contrast to FIG. 3A, in FIG. 3B the exposed tip 75 of the node ground wire is now in geologic structure 50, away from cement 55. The ground wire remains insulated 70 inside cement, however.

It may be preferable to use cement 55 instead of geologic structure 50 for power delivery and completing the circuit of the AC unit. First, cement is (or can be made by adding dopants) more electrically conductive than the geologic structure. Second, it may be easier to secure the electrode portions 75 and 70 inside cement than to push the insulated portion 70 though cement and expose portion 75 in the geologic structure.

Yet another alternate embodiment of FIG. 3A for delivering power through cement 55 is to transmit power using the conductivity of the cement directly by exposing the node's ground connection to cement, thus eliminating the floating ground wire completely.

The present approach uses circuitry modeling with inputs of estimated electrical parameters to determine starting values for AC power supply specifications and settings. These parameters, such as impedance, resistivity, capacitance, etc., are estimates from available data and/or electrically modeling of the underground rig's physical layout and its electrical properties. The system controller 700 fine tunes the power supply specifications, frequency and peak voltage settings, starting from the values obtained from circuitry modeling.

Figure 4:
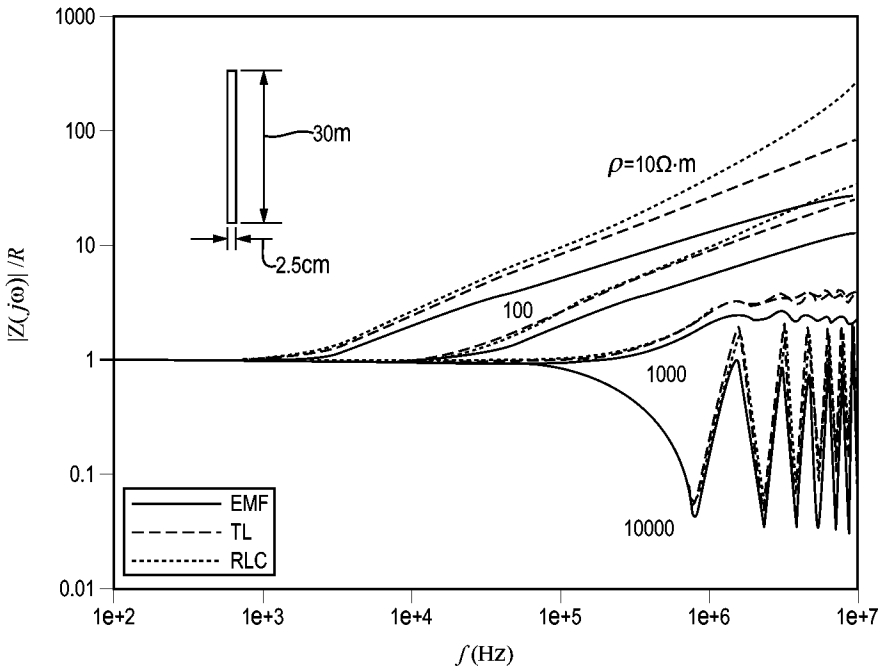
FIG. 4 is a plot of modeled impedance as a function of frequency of a 30 meter (m) long casing with a shell thickness of 2.5 centimeters (cm) for various values of DC resistance, 10 to $10^4$ Ω-m.

FIG. 4 is a plot of impedance versus AC frequency (in Hz) for various values of soil DC resistivity, $\rho$=10, 100, 1000 and 1000 Ω-m, using 3 different models, EMF, TL and RLC. The acronyms stand for buried conductor models: RLC=resistor/inductor/capacitor equivalent circuit, TL=transmission line and EMF=electromagnetic finite element analysis. The figure shows normalized impedance of a 30 meter deep conductor that is 2.5 cm in diameter.

Regarding the results displayed in FIG. 4, there is uncertainty concerning the inputs to model of the electrical behavior of deeply buried, vertically-oriented conductors. Therefore, only some broad and approximate conclusions can be inferred from the results of these model computations. The models all predict that the input impedance of the buried rod at higher frequencies will usually be higher than the DC resistance of the rod and, not surprisingly, that higher resistivity soil results in higher input impedance. The calculations indicate that the RLC model (used in this disclosure) is consistent with other, more detailed models of buried vertical conductors.

A few impulse impedance measurements have been published that characterize vertically-oriented conductive structures buried in soil, but not to depths representative of a downhole casing.

Figure 5:
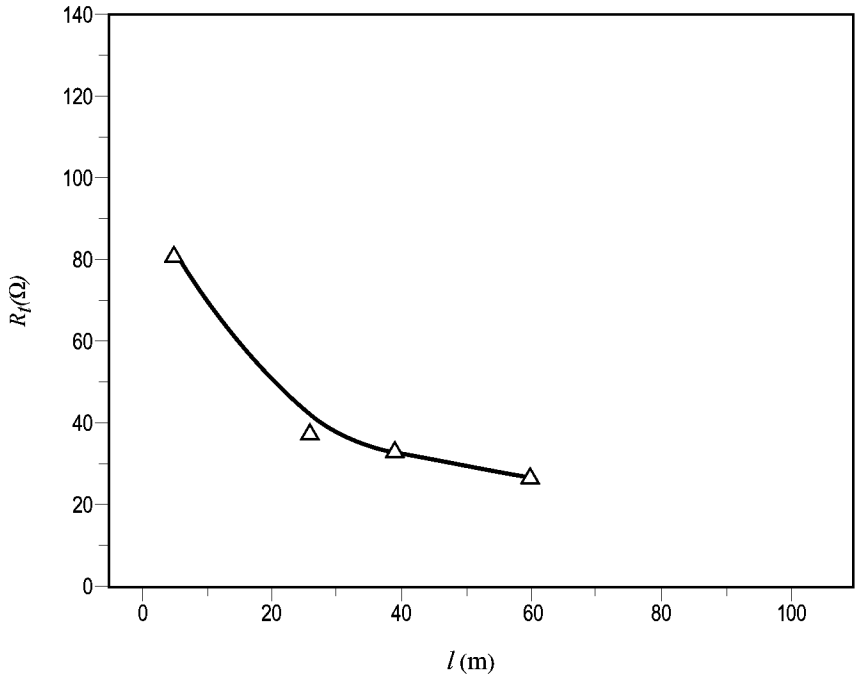
FIG. 5 is a plot of impulse resistance data (resistance to a Dirac delta function voltage input) of a vertical metal rod versus its length; see Jinliang He, et al., "Laboratory Investigation of Impulse Characteristics of Transmission Tower Grounding Devices", IEEE Trans Power Delivery, Vol. 18, No. 3, July 2003.

FIG. 5 displays measurement data of impulse resistance of a vertical metal rod of various lengths up to a maximum of 60 m. Although not as deep (or as large diameter) as a well casing pictured in FIGS. 1A and 1B, the response in FIG. 5 is representative of expected input characteristics for vertical conductors penetrating far into the earth. It is well established that steel surrounded by cement, buried in soil, results in a relatively low DC resistance connection to ground (high value of conductance G', which is the reciprocal of resistance, in the equivalent circuits shown in FIGS. 6A, 6B and 6C, ahead), but less is known about the VLF (very low frequency) and LF (low frequency) response of such a structure.

Figure 6A:
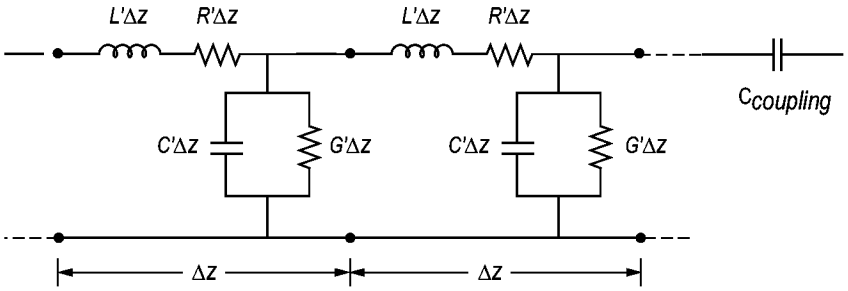
FIG. 6A is a circuit diagram showing a lumped electrical analog of the casing and surroundings enclosed between two levels, the earth surface and the first coupling with capacitance $C_{coupling}$.

FIG. 6A is a lumped electrical analog of the casing and surroundings enclosed between two levels, the earth surface 110 and the coupling 25-1-2 as indicated in FIGS. 1A and 1B. The model is for a lossy transmission line coupled with capacitors, $C_{coupling}$. Each lumped element value is expressed per unit length Δz; i.e., L' is in units of inductance per meter (of casing), C' is in units of capacitance per meter, G' is in units of conductance per meter, and R' is in units of resistance per meter. The coupling capacitance, $C_{coupling}$, represents the capacitance between the casing and the cement near a coupling, and is not a value per unit distance. The dissipative loss in the casing transmission line is specified through the resistance per unit length, R'. The capacitance and current leakage path to the surrounding geologic structure through the cement are represented by C' and G', respectively.

Figure 6B:
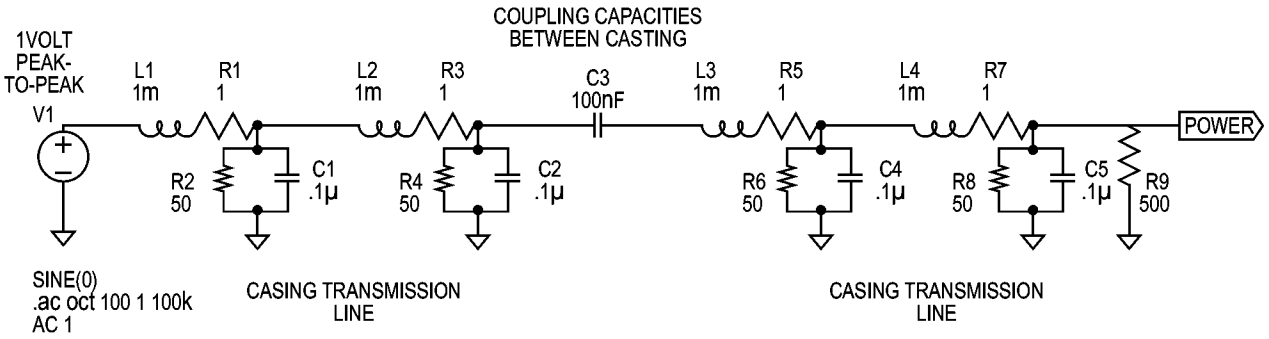
FIG. 6B is circuit diagram showing a full electrical circuit analog of a segment of the casing, which includes the second node and two casing couplings.

FIG. 6B is the full lumped electrical circuit analog of vertically buried coupled casing sections, representing a segment of FIGS. 1A and 1B which includes the segment from surface of earth 110 up to but not including the second node 25-2-3. The power unit 1510, normalized to 1V peak power, is represented by V1. It includes first two casing sections, each taken to be 500 m long for a total casing length of ≈1 km. The complete circuit in this figure includes several lumped circuit elements shown in FIG. 6A. C3 represents the coupling capacitance of coupling 25-1-2. The value of inductances L1=L2=L3=L4 and resistances R1=R3=R5=R7 are estimated from the calculated piecewise inductance and resistance of a steel casing cylinder (piecewise length=250 m). Likewise, the capacitances C1=C2=C3=C4 and resistances R2=R4=R6=R8 are estimates of the piecewise capacitance and DC resistance to ground. The value of resistor R9 represents approximately two times the resistance to local ground obtainable at the point along the casing where power is delivered; i.e., half the power delivered to this model element is the power that can be delivered to a sensing or transmit/receive node located near coupling 25-2-3. The other half of the power, approximately, is dissipated in the cement and the geologic structure surrounding the casing. The values of the combination of inductances, capacitances, and resistances are consistent with what is known about the AC input impedance at V1; i.e., the input impedance of the circuit model shown in FIG. 6B results in a frequency dependence of normalized input impedance, $|Z(j\omega)|/R$, similar to those plotted in FIG. 4 for soil resistivity of 100 Ω-m. This comparison with FIG. 4 establishes the relevance of the results in FIG. 4, and, as importantly, validates the model embodied in FIG. 6B.

Figure 6C:
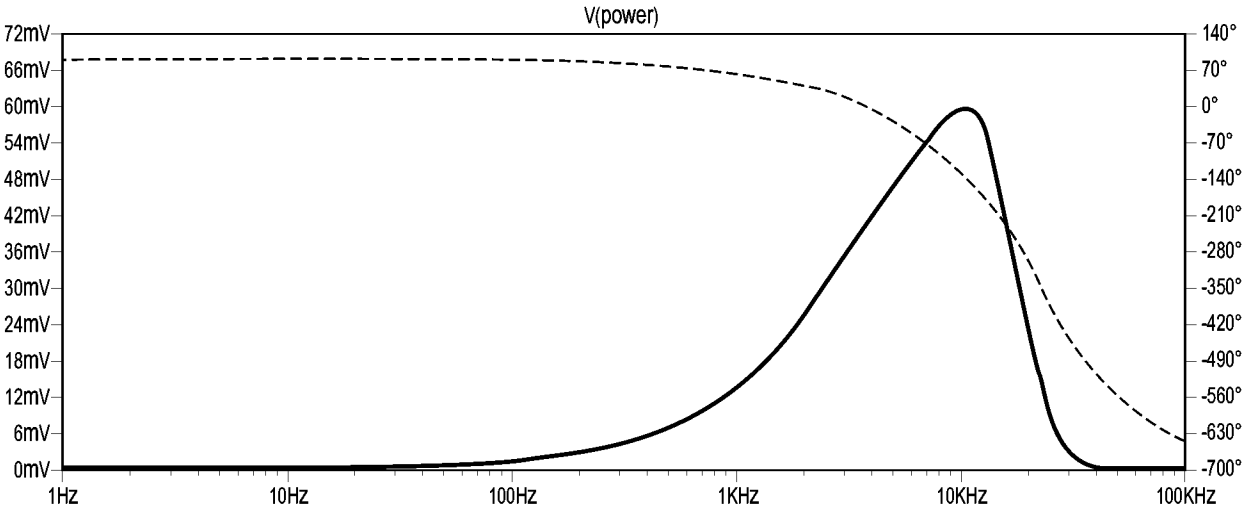
FIG. 6C is a plot showing the frequency and phase response of the circuit shown in FIG. 6B for an input voltage of 1 Volt (V) peak amplitude.

The next figure, FIG. 6C, shows amplitude and phase angle as a function of frequency at the node labeled "Power" in FIG. 6B for a 1 V peak applied at V1. From the figure clearly the maximum power delivered to the node occurs at near 10 kHz frequency. The circuit simulation thus performed indicates that for a sensor located at this node will get ample power from a 10 kHz AC circuit.

Figure 7:
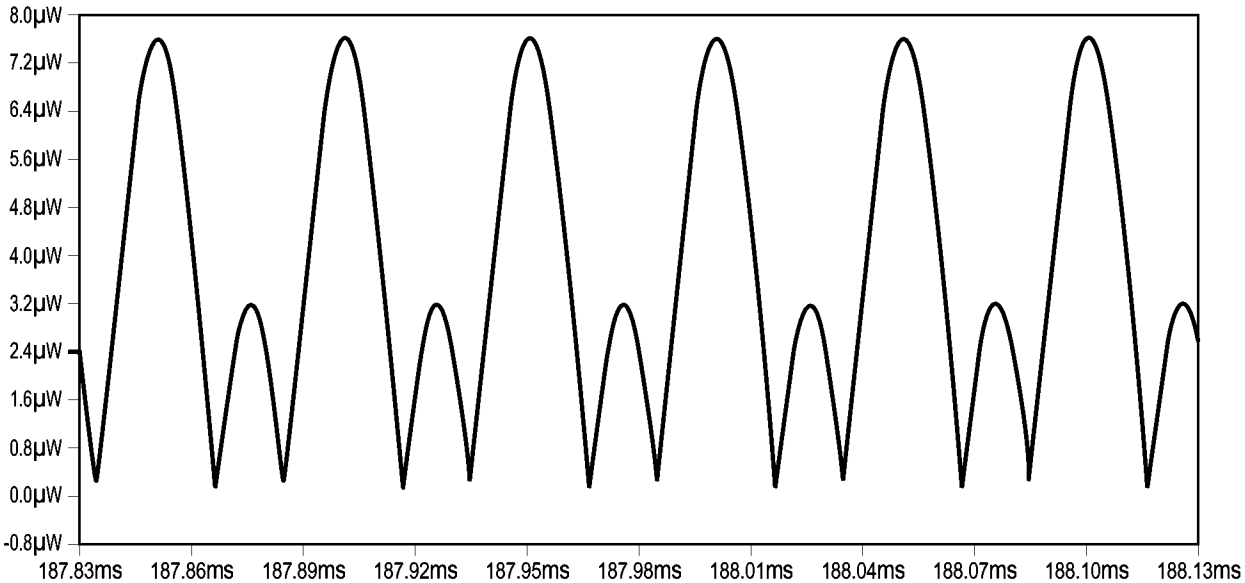
FIG. 7 is a plot showing the instantaneous power delivered to the load resistor R9 of FIG. 6B for an input of 1 V peak amplitude and of frequency 10 kHz.

FIG. 7 shows the instantaneous power delivered to the load resistor, R9=500Ω, for a 1 V peak input amplitude 10 kHz signal applied at V1. The calculation in this figure can be used to determine what input voltage (or input power) would be needed on the surface of the earth 110 at the AC power unit 1510 pictured in FIGS. 1A and 1B to deliver a specified power at the underground node (1 km depth). The RMS power delivered by the 1 V peak source at 10 kHz is 3.72 μW. Therefore, as an example, if trickle charging is being used to deliver 500 μW to a battery or capacitor at the node, the peak source voltage on the surface would be about 16.4 V. Under these conditions, the source would supply about 0.67 W at the surface input to provide 500 μW at the node.

It is important to note that for a well with different electrical parameters, these numbers will be different. These numbers are cited for illustrative purposes for a typical well with typical RLC values.

Although the efficiency in power delivery to the deeply buried node is low, relatively low charging power can be sufficient for intermittent operation of (underground) low power node electronics. If more power is needed, the peak source voltage can be increased. Furthermore, a single source at the surface can power multiple nodes.

The circuit embodied in FIG. 6B for modeling the casing and surroundings is a type of RLC circuit (L=inductance, C=capacitance) that can be used to achieve resonance at certain tuned frequencies. At the right frequency, which in this case appears to be about 10 kHz, the resonance AC source will create standing wave patterns of electrical power at certain equidistant positions in the casing, provided the casing sections, including cement and geologic structures, have similar impedance, resistance and capacitance values. In the current embodiment featuring a resonant power delivery design system, the AC power unit is tuned such that standing waves of AC power are at relative maxima at the locations of the nodes. In general, the strength of the present system is that the standing wave can be modified to hit a given node. In one example, the ground station will schedule power delivery operations for different times of day to different nodes. For example, in one hour, the frequency/standing wave is selected to deliver power to one group of nodes, then the frequency is changed to deliver power to another group of nodes for the next hour.

In general, the nodes may be located at arbitrary positions along the casing. Electrical parameters, i.e., frequency and power, of the power delivery system can be tuned such that standing wave maxima coincide with the nodes whose telemetry signals are desired. It may not be necessary to monitor all the nodes simultaneously at all times. For example, as the well gets deeper, measurements from certain nodes closer to the surface may not be required. The power delivery system, therefore, can focus on delivering power to the deeper nodes. Similarly, power delivery can also be scheduled for different nodes at different times during daily operations of the well the day.

Figure 8:
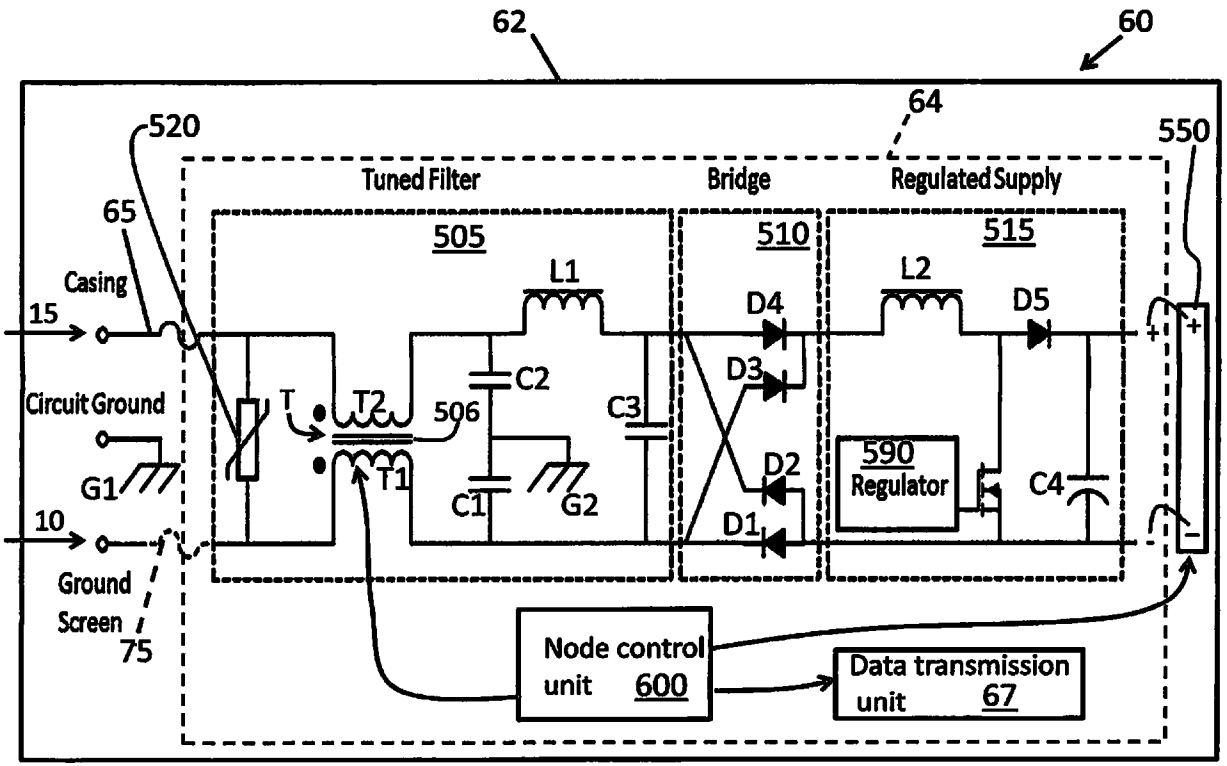
FIG. 8 is a diagram of the electronic components of the node including the power extraction circuit for the node, the control unit and data transmission unit.

FIG. 8 shows an embodiment of a node 60. The node housing 62 protects the inner node circuitry 64, shown in FIGS. 3A and 3B, along with its components, namely, tuned filter 505, bridge 510, regulated supply 515, node control unit 600 and the data transmission unit 67. Each component encased within the housing 62 will be described below.

The power extraction circuit components, which act in sequence, are the tuned filter 505, bridge 510 and regulated supply 515.

The input power to tuned filter 505 of power extraction circuit comes from the node's casing electrode 65, which is in direct contact with casing through electrode 15 of the AC power unit 1510. In examples, the connections to the casing are made using a glass-to-metal seal with an electrically isolated "button."

To complete the AC circuit, the node's second electrode 75 is connected to the AC power unit's (1510) ground stake 10 through the geologic structure 50 or cement 55 (FIGS. 3A and 3B). In the circuit diagram of the tuned filter 505, letters "C", "L", "T" and "D", followed by a number, denote capacitor, inductor, transformer and diode elements, respectively. The tuned filter 505 includes a tunable transformer T having windings T1 and T2 surrounding a core 506. The tunable transformer T lowers the voltage from the AC unit to a value appropriate for the node. It also tunes the resonance of the tuned filter circuit to match the frequency of the AC power supplied by the AC power unit 1510.

The capacitors C1, C2 and C3 and the inductor L1 are configured to act as a low-pass filter to deny high frequency AC components to pass to the bridge circuit 510. Ground connection G2 allows any excess AC current to flow to the ground. The Zener diode 520 controls the voltage passed though the tuned filter 505. The diode 520 thus acts as surge protector.

The bridge 510 in the middle of power extraction circuitry to converts AC output to DC voltage. The diodes D1, D2, D3 and D4 in the bridge circuit 510, which is a full wave rectifier, shunt DC component into the "+" line.

The regulated supply circuitry 515 uses the inductor L2 to further filter out high frequency components and condition the voltage and current. The diode D5 and capacitor C4 ensure direct flow of DC current to the transducer 550 and also possibly the node control unit 600 and data transmission unit 67. Finally the regulator 590 acts to control the voltage level for the transducer 550.

The transducer 550 requires DC voltage to power its electronics directly and/or to charge its battery that provides power to the node electronics. The output of the DC power from the power extraction circuit 64 is of fixed polarity indicated by "+" and "−" signs.

The node control unit 600, typically a microcontroller, regulates the tunable transformer T in tuned filter 505. The node control unit reads the transducer 550 and also the information from the transducer to the data transmission unit 67. The transmission unit encodes the transducer information as telemetry data, which is then transmitted to the TCU 100.

Figure 9:
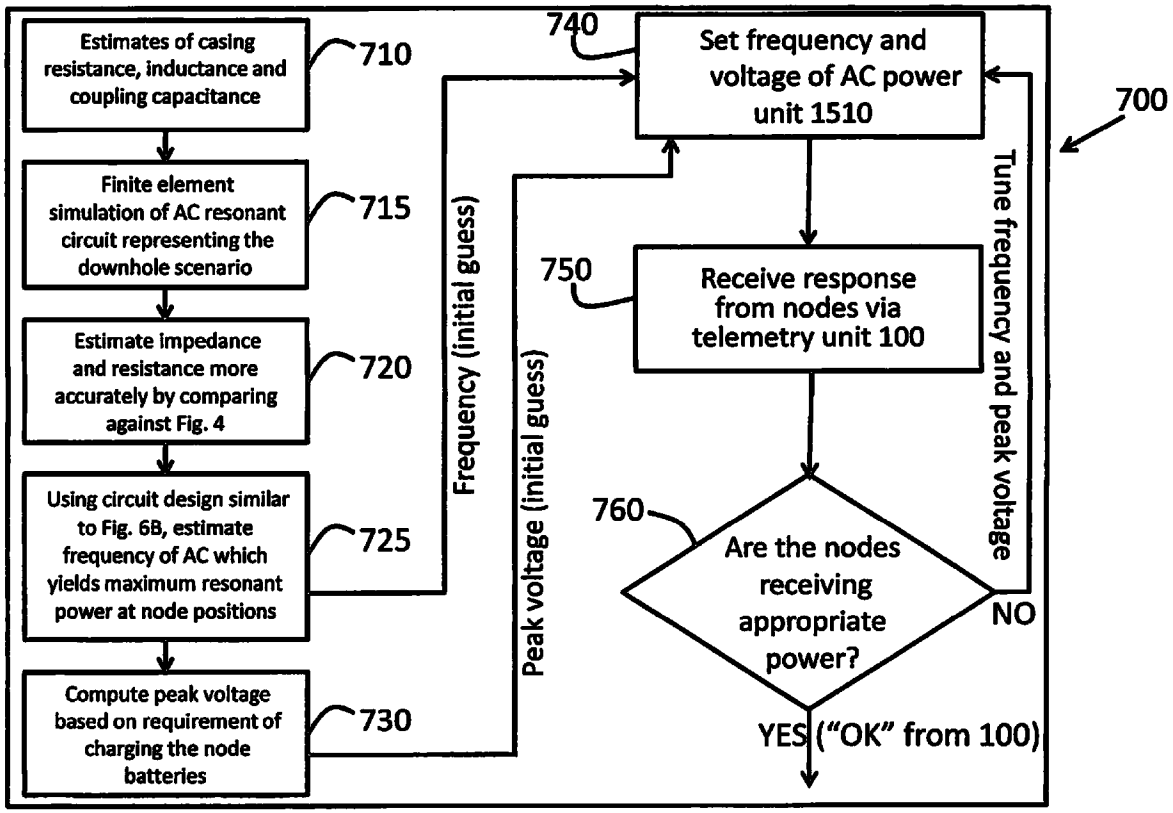
FIG. 9 is the flow diagram showing the functioning of the system controller which tunes the AC power unit and communicates with the telemetry unit.

FIG. 9 is a flow diagram showing the operation of a control system 700.

In general, the control system 700 tunes the AC power unit 1510 to operate at optimum frequency and power (peak voltage) so that all the nodes will have sufficient power to sense and transmit data to the telemetry control (TCU) 100.

The frequency is the more difficult of the two parameters, voltage and frequency, to determine. The optimum frequency will create the standing waves in the casting 20. The frequency is selected so that the positions of maximum power (antinodes) will be approximately located at the locations of the various nodes 60-1, 60-2 along the casing. Determination of voltage is a simple matter of scaling the AC unit's power. It must be scaled to a value that will deliver needed the power to the farthest (deepest location) node 60. Even though the nodes will all be located at the relative maxima (antinodes) of the standing waves, those at the deepest parts of casing will get progressively less power. Therefore, in order to ensure that all nodes 60 have enough power, one must scale the AC power (peak voltage) to match the requirement of the node located at the highest depth.

In FIG. 9, in step 740, the system controller 700 determines the frequency and voltage of the AC power unit 1510. The initial guess of best AC frequency is provided in step 725 which determines that value by analysis of a circuit similar to FIG. 6B. The initial guess of peak voltage is determined by analyzing the power output of step 730 (similar to FIG. 7) and prior knowledge of power requirements of the sensor nodes. The parameters for executing the simulation circuit are provided in steps 710 (electrical parameters such as resistance, inductance and coupling capacitance for a circuit similar to FIG. 6B), 715 (solving equation for circuit 6B) and 720 (more accurate estimate of impedance and resistance), respectively.

More than likely the guesses of frequency and voltage values obtained from steps 725 and 730, which are based on simulations, will not be the ideal parameters for the real world power requirements at the nodes 60. Whether the power and voltage specifications of the power unit 1510 are adequate, i.e., the frequency and peak voltage produce a resonance LC circuit with enough power for the nodes, will be determined by the control unit 700 after receiving proper response from the TCU 100 in step 750. The TCE 100 responds based on the telemetry data transmitted by the various nodes 60-1, 60-2 along the casing 20.

In step 760, the control unit decides, based on and "YES" or "NO" response from the TCU 100, if AC power specifications are correct or not. If the response is "YES", this will signify that nodes are functioning properly and telemetry data acquisition can proceed as normal. On the other hand if the decision in step 760 is a "NO", indicating inadequate power supply to the nodes, step 740 will be repeated with a new pair of incrementally changed frequency and voltage specifications. Thus, the tuning of the AC power unit is an iterative process, primarily based on the response from the TCU 100.

Iterations of frequency and power in 740 depend on a "YES" or "NO" signal from TCU 100. If there is an absence of any signal (neither "YES" nor "NO") from some or all of the nodes, it probably points to fully discharged batteries at the nodes and/or the fact that the nodes' electrode connections are located at a nodal point of the standing wave. Until the nodes are able to communicate with TCU 100, frequency and power parameters must be determined by a "hunt and wait" method, which can be automated using software. The "hunt" part describes selecting a power specification (frequency and peak voltage) to supply power to the nodes, and the "wait" part refers to waiting for the nodes to start communication with TCU 100. After a reasonable time, if the nodes are still not communicating one must try a different frequency and power for the AC unit.

This method is necessary if the node batteries are completely exhausted and their electrical circuitry cannot be activated until the batteries are fully charged. Typically, in most devices such as cell phones and computers, active power supply will activate the electronic and charge the battery simultaneously. So there may not be a need to "wait" for the batteries to be charged.

Having described the "hunt and wait" nature of the iterative tuning of AC power unit parameters, it should be noted that the simulation method described in this invention to determine initial parameters of the AC power unit should be good starting points of the parameter values, and they should make the "hunt and wait" method not an insurmountable problem.

While this invention has been particularly shown and described with references to preferred embodiments thereof, it will be understood by those skilled in the art that various changes in form and details may be made therein without departing from the scope of the invention encompassed by the appended claims.

What is claimed is:

1. A downhole node for a well, comprising:

a node housing set in cement, the cement surrounding a casing of the well, a power electrode extending from the node housing to the casing; and a ground electrode extending from the node housing to the cement and/or surrounding geologic structure;

wherein the node is powered by a power source for transmitting AC power to the node via the casing by establishing a standing wave in the casing, wherein the power source adjusts a frequency of the AC power to ensure that the node is located at an antinode of the standing wave.

2. The node of claim 1, wherein the node comprises node circuitry including a tuned filter for receiving power via the power electrode and being grounded via the ground electrode.

3. The node of claim 1, wherein the node comprises node circuitry including a bridge circuit for rectifying power transmitted via the casing.

4. The node of claim 1, wherein the node comprises node circuitry including a regulated supply for conditioning power transmitted via the casing.

5. The node of claim 1, wherein the node comprises node circuitry including a Zener diode connected between the power electrode and ground electrode for protecting the node from over voltage.

6. The node of claim 1, further comprising an insulating cover over the casing.

7. The node of claim 6, wherein the insulating cover is a layer of plastic.

8. The node of claim 6, wherein the insulating cover is a paint layer.

9. The node of claim 1, wherein the power electrode connection to the casing is protected with a glass-to-metal seal.

10. A well telemetry system for a well, comprising:

one or more nodes set in cement, the cement surrounding a casing of the well; and a power source for transmitting AC power to the nodes via the casing by establishing a standing wave in the casing; and wherein the power source adjusts a frequency of the AC power to ensure that the nodes are located at antinodes of the standing wave.

11. The system of claim 10, wherein a frequency of the AC power from the power source is tuned in response to data from the nodes.

12. The system of claim 10, further comprising an insulating cover over the casing.

13. The system of claim 12, wherein the insulating cover is a layer of plastic.

14. The system of claim 12, wherein the insulating cover is a paint layer.

15. The system of claim 10, wherein each of the nodes comprises:

a node housing set in the cement;

a power electrode extending from the node housing to the casing; and a ground electrode extending from the node housing to the cement and/or surrounding geologic structure.

16. The system of claim 15, wherein the nodes each comprise node circuitry including a tuned filter for receiving power via the power electrode and being grounded via the ground electrode.

17. The system of claim 15, wherein the nodes each comprise node circuitry including a bridge circuit for rectifying the AC power transmitted via the casing.

18. The system of claim 15, wherein the node comprises node circuitry including a regulated supply for conditioning the power transmitted via the casing.

19. The system of claim 15, further comprising an insulating cover over the casing.

20. The system of claim 19, wherein the insulating cover is a layer of plastic or a paint layer.

* * * * *